US006140893A

United States Patent [19]

Sciarrino

[11] Patent Number: 6,140,893

[45] Date of Patent: Oct. 31, 2000

[54] WAVEGUIDE INTERCONNECTION SYSTEM

[76] Inventor: Anthony J. Sciarrino, 1760 St. Paul Dr., Clearwater, Fla. 34624

[21] Appl. No.: 09/298,880

[22] Filed: Apr. 26, 1999

[51] Int. Cl.[7] ..... H01P 1/04

[52] U.S. Cl. ..... 333/254; 333/255

[58] Field of Search ..... 333/254, 255; 285/33, 330, 414

[56] References Cited

U.S. PATENT DOCUMENTS

| | | | |
|---|---|---|---|
| 2,774,616 | 12/1956 | Dodd et al. | 285/33 |
| 3,076,948 | 2/1963 | Misner | 333/255 |
| 3,605,041 | 9/1971 | Judkins | 333/254 X |
| 3,821,670 | 6/1974 | Thompson | 333/255 |
| 4,686,498 | 8/1987 | Carr et al. | 333/255 X |

*Primary Examiner*—Paul Gensler

[57] ABSTRACT

A waveguide interconnection system. First and second waveguide sections each have an exterior end and an interior end. A first flange, formed in a cylindrical configuration, has an inboard surface in a planar configuration positionable adjacent to the first waveguide section adjacent to the interior end thereof. The first flange has an outboard surface, a peripheral exterior surface with male threads formed thereon, and an opening therethrough essentially coextensive as an extension of the cross-section of the waveguide. A second flange, formed in a cylindrical configuration, is positionable adjacent to the second waveguide section adjacent to the inboard end thereof. The second flange has an outboard surface and an inboard surface in a generally planar configuration with a peripheral surface therebetween and an opening centrally therethrough essentially coextensive as an extension of the cross-section of the second waveguide. A coupler, formed in a cylindrical configuration with a knurled external periphery, has an aperture adapted to contact the exterior surface of the second flange and a recess with interior female threads extendable beyond the interior surface of the second flange into mating contact with the male threads of the first flange.

5 Claims, 3 Drawing Sheets

FIG 5
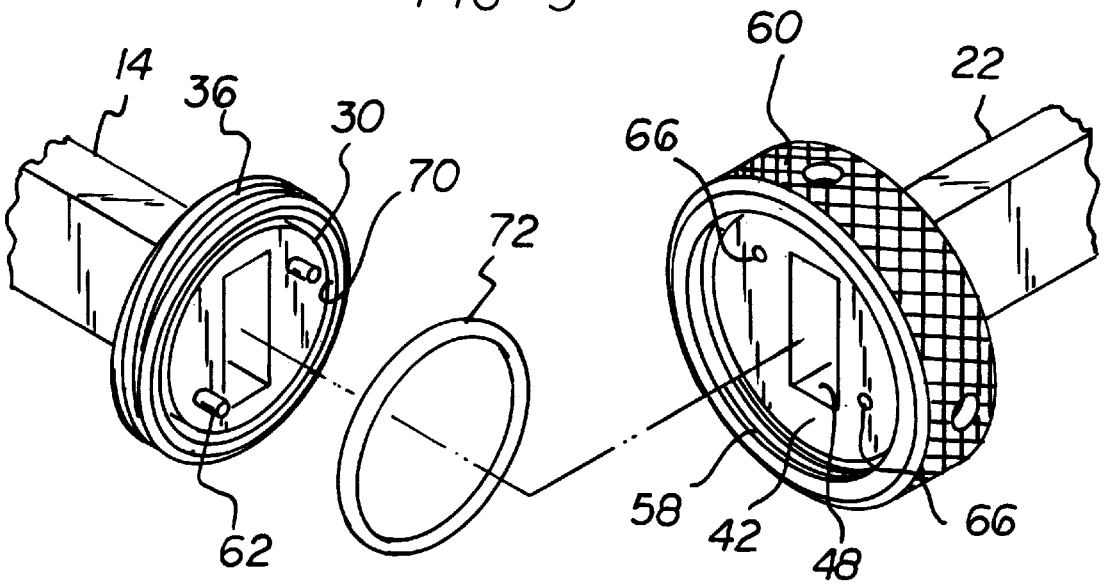
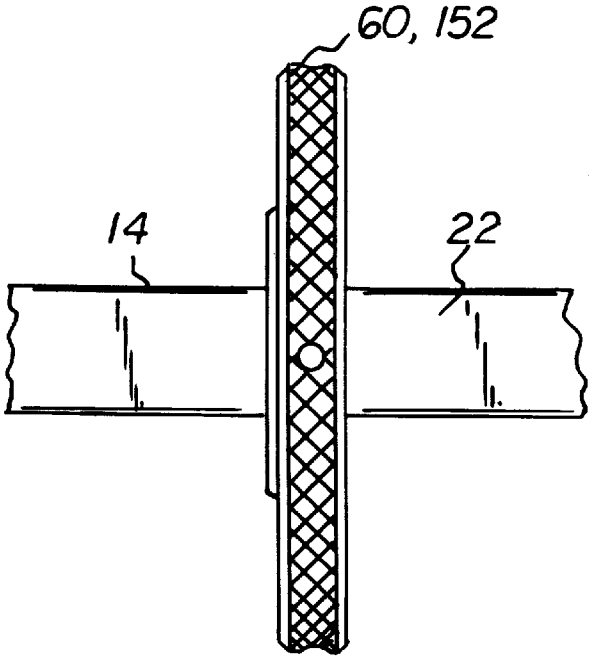
FIG 6

WAVEGUIDE INTERCONNECTION SYSTEM

BACKGROUND OF THE INVENTION

1. Field of the Invention

The present invention relates to a waveguide interconnection system and more particularly pertains to adapting waveguide systems for quick and convenient coupling and uncoupling of related sections.

2. Description of the Prior Art

The use of waveguides and interconnects of known designs and configurations is known in the prior art. More specifically, waveguides and interconnects of known designs and configurations heretofore devised and utilized for the purpose of coupling and uncoupling sections of waveguides through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,821,670 to Thompson discloses a waveguide alignment and quick disconnect coupler. U.S. Pat. No. 4,011,532 to Williams et al discloses a fast acting waveguide coupler.

While these devices fulfill their respective, particular objectives and requirements, the aforementioned patents do not describe a waveguide interconnection system that allows adapting waveguide systems for quick and convenient coupling and uncoupling of related sections.

In this respect, the waveguide interconnection system according to the present invention substantially departs from the conventional concepts and designs of the prior art, and in doing so provides an apparatus primarily developed for the purpose of adapting waveguide systems for quick and convenient coupling and uncoupling of related sections.

Therefore, it can be appreciated that there exists a continuing need for a new and improved waveguide interconnection system which can be used for adapting waveguide systems for quick and convenient coupling and uncoupling of related sections In this regard, the present invention substantially fulfills this need.

SUMMARY OF THE INVENTION

In view of the foregoing disadvantages inherent in the known types of waveguides and interconnects of known designs and configurations now present in the prior art, the present invention provides an improved waveguide interconnection system. As such, the general purpose of the present invention, which will be described subsequently in greater detail, is to provide a new and improved Waveguide interconnection system and method which has all the advantages of the prior art and none of the disadvantages.

To attain this, the present invention essentially comprises a wave guide interconnection system. The present invention, the waveguide interconnection system is comprised of a plurality of components. Such components in their broadest context include a first waveguide section, a second waveguide section, a first flange, a second flange, a coupler, a plurality of diametrically opposed locator pins, and a plurality of coacting opposed locator apertures. Such components are individually configured and correlated with respect to each other so as to attain the desired objective.

The waveguide interconnection system is adapted to readily couple and uncouple abutting waveguide sections. A first waveguide section has a rectangular cross-sectional configuration with an exterior end and an interior end. A second waveguide section has a rectangular cross-sectional configuration with an exterior end and an interior end. A male first flange is formed in a cylindrical configuration. The first flange has an inboard surface in a planar configuration positionable over the first waveguide section adjacent to the interior end thereof. The first flange has an outboard surface. The first flange also has a peripheral exterior surface with male threads formed thereon. The first flange has a generally rectangular opening centrally therethrough essentially coextensive as an extension of the cross-section of the waveguide. A female second flange is formed in a cylindrical configuration. The second flange is positionable over the second waveguide section adjacent to the inboard end thereof. The second flange has an outboard surface and an inboard surface in a generally planar configuration with a peripheral surface therebetween. The second flange has a generally rectangular opening centrally therethrough essentially coextensive as an extension of the cross-section of the second waveguide. A coupler in a cylindrical configuration has a circular aperture adapted to contact the exterior surface of the second flange. The coupler also has a recess with interior female threads extendable beyond the interior surface of the second flange into mating contact with the male threads of the first flange. The coupler has a knurled external periphery. A pair of diametrically opposed locator pins extend outwardly from the first flange at diametrically opposed locations offset from both axes of the rectangular opening therein. A pair of coacting opposed locator apertures in the second flange are adapted to receive the pins of the first flange. An annular recess is formed in the first flange with an elastomeric O-ring situated therein for sealing the first and second flanges when coupled. A supplemental male flange is provided in a generally cylindrical configuration. The supplemental flange has external peripheral screw threads thereon and a collar located around the second waveguide and flexible coupling components therebetween adapted to be interconnected with the second flange when the waveguides are uncoupled. A female supplemental flange is provided in a cylindrical configuration with internal screw threads thereon. The female supplemental flange has a collar located around the first waveguide and flexible coupling components therebetween adapted to be interconnected with the first flange when the waveguides are uncoupled.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved waveguide interconnection system which has all of the advantages of the prior art waveguides and interconnects of known designs and configurations and none of the disadvantages.

It is another object of the present invention to provide a new and improved waveguide interconnection system which may be easily and efficiently manufactured and marketed.

It is further object of the present invention to provide a new and improved waveguide interconnection system which is of durable and reliable constructions.

An even further object of the present invention is to provide a new and improved waveguide interconnection system which is susceptible of a low cost of manufacture with regard to both materials and labor, and which accordingly is then susceptible of low prices of sale to the consuming public, thereby making such Waveguide interconnection system economically available to the buying public.

Even still another object of the present invention is to provide a waveguide interconnection system for adapting waveguide systems for quick and convenient coupling and uncoupling of related sections.

Lastly, it is an object of the present invention to provide a new and improved waveguide interconnection system. First and second waveguide sections each have an exterior end and an interior end. A first flange, formed in a cylindrical configuration, has an inboard surface in a planar configuration positionable adjacent to the first waveguide section adjacent to the interior end thereof. The first flange has an outboard surface, a peripheral exterior surface with male threads formed thereon, and an opening therethrough essentially coextensive as an extension of the cross-section of the waveguide. A second flange, formed in a cylindrical configuration, is positionable adjacent to the second waveguide section adjacent to the inboard end thereof. The second flange has an outboard surface and an inboard surface in a generally planar configuration with a peripheral surface therebetween and an opening centrally therethrough essentially coextensive as an extension of the cross-section of the second waveguide. A coupler, formed in a cylindrical configuration with a knurled external periphery, has an aperture adapted to contact the exterior surface of the second flange and a recess with interior female threads extendable beyond the interior surface of the second flange into mating contact with the male threads of the first flange. A plurality of diametrically opposed locator pins extend outwardly from the first flange. A plurality of coacting opposed locator apertures in the second flange arc adapted to receive the pins of the first flange.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded perspective view of the central components shown in FIGS. 1, 2, and 4.

FIG. 6 is a side elevational view of the central components shown in FIG. 1 but illustrating an alternate embodiment with enlarged members.

The same reference numerals refer to the same parts throughout the various Figures.

DESCRIPTION OF THE PREFERRED EMBODIMENT

Figure 1:
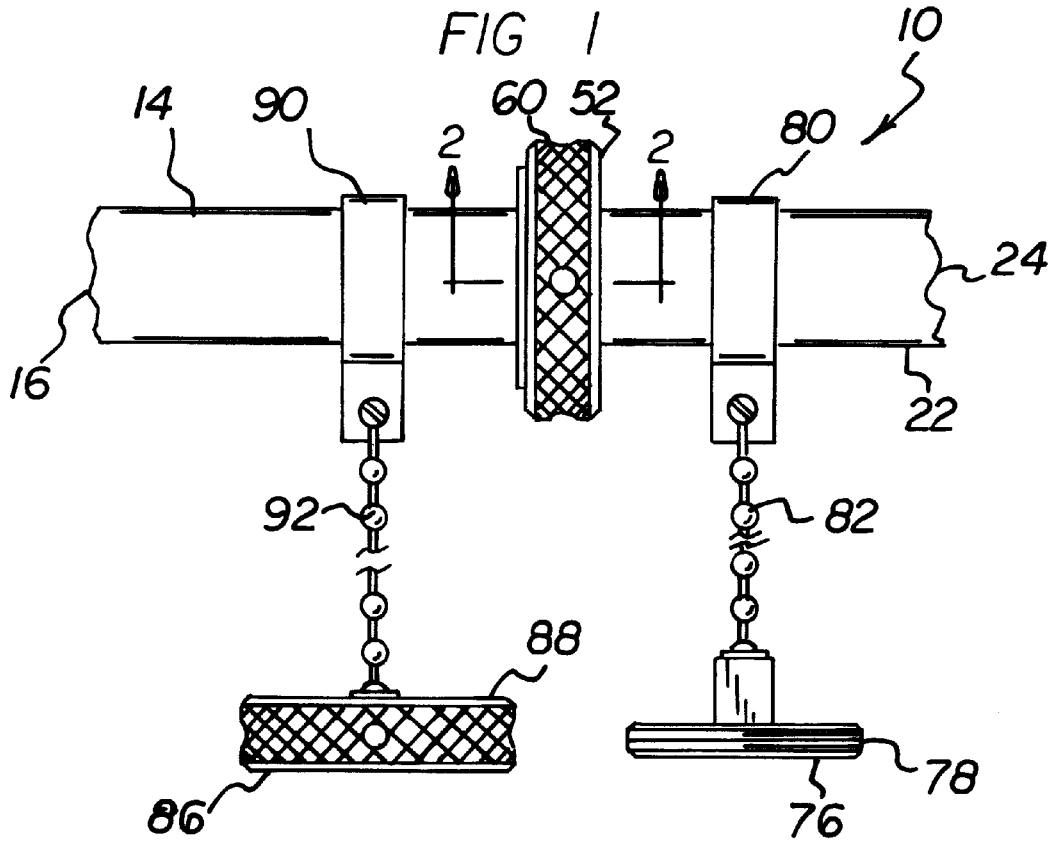
FIG. 1 is an elevational view of the new and improved waveguide interconnections system constructed in accordance with the principles of the present invention.
Figure 2:
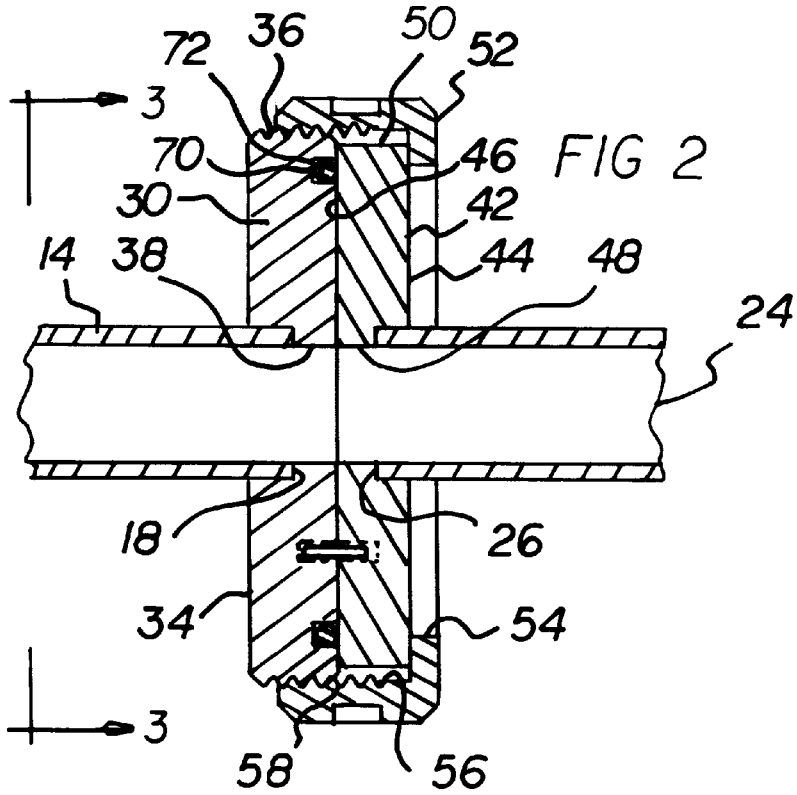
FIG. 2 is a cross-sectional view of the central components taken along line 2—2 of FIG.
Figure 3:
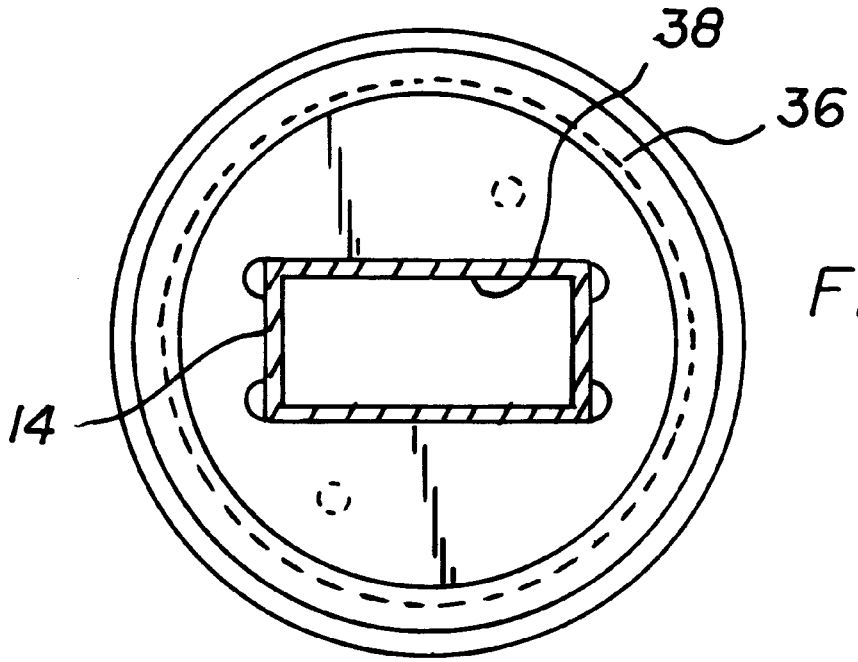
FIG. 3 is a cross-sectional view taken along line 3—3 of FIG. 2.
Figure 4:
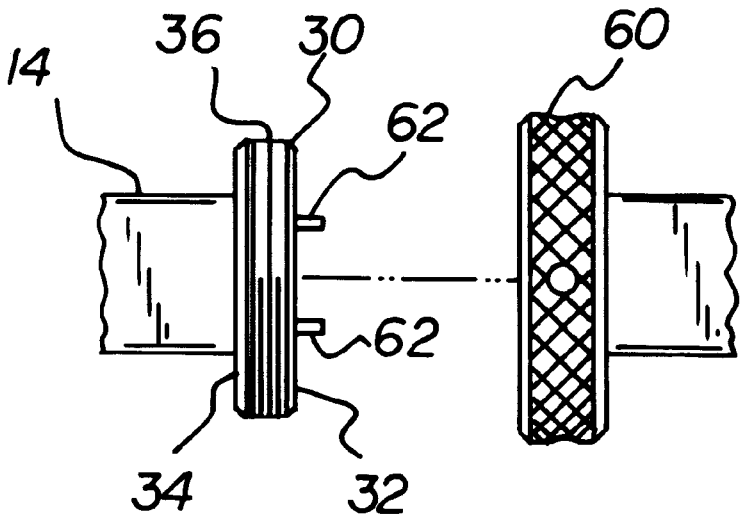
FIG. 4 is an exploded elevational view of the central components shown in FIGS. 1 and 2.

With reference now to the drawings, thereof, the preferred embodiment of the new and improved waveguide interconnection system embodying the principles and concepts of the present invention and generally designated by the reference numeral 10 will be described.

The present invention, the waveguide interconnection system 10 is comprised of a plurality of components. Such components in their broadest context include a first waveguide section, a second waveguide section, a first flange, a second flange, a coupler, a plurality of diametrically opposed locator pins, and a plurality of coacting opposed locator apertures. Such components are individually configured and correlated with respect to each other so as to attain the desired objective.

The waveguide interconnection system 10 is adapted to readily couple and uncouple abutting waveguide sections. A first waveguide section 14 has a rectangular cross-sectional configuration with an exterior end 16 and an interior end 18. A second waveguide section 22 has a rectangular cross-sectional configuration with an exterior end 24 and an interior end 26.

A male first flange 30 is formed in a cylindrical configuration. The first flange has an inboard surface 32 in a planar configuration positionable over the first waveguide section adjacent to the interior end thereof. The first flange has an outboard surface 34. The first flange also has a peripheral exterior surface with male threads 36 formed thereon. The first flange has a generally rectangular opening 38 centrally therethrough essentially coextensive as an extension of the cross-section of the waveguide.

A female second flange 42 is formed in a cylindrical configuration. The second flange is positionable over the second waveguide section adjacent to the inboard end thereof. The second flange has an outboard surface 44 and an inboard surface 46 in a generally planar configuration with a peripheral surface 50 therebetween. The second flange has a generally rectangular opening 48 centrally therethrough essentially coextensive as an extension of the cross-section of the second waveguide.

A coupler 52 in a cylindrical configuration has a circular aperture 54 adapted to contact the exterior surface of the second flange. The coupler also has a recess 56 with interior female threads 58 extendable beyond the interior surface of the second flange into mating contact with the male threads of the first flange. The coupler has a knurled external periphery 60. An alternate embodiment of the invention, shown in FIG. 6, has an enlarged coupler 152 with an enlarged cylindrical configuration with a mass sufficient to create spinning forces to effect secure coupling of the flanges by threadedly coupling the male threads of the first flange 42 without excessive gripping forces imparted by a user.

A pair of diametrically opposed locator pins 62 extend outwardly from the first flange at diametrically opposed locations offset from both axes of the rectangular opening therein. A pair of coacting opposed locator apertures 66 in the second flange are adapted to receive the pins of the first flange.

An annular recess 70 is formed in the first flange with an elastomeric O-ring 72 situated therein for sealing the first and second flanges when coupled.

A supplemental male flange 76 is provided in a generally cylindrical configuration. The supplemental flange has external peripheral screw threads 78 thereon and a collar 80 located around the second waveguide and flexible coupling components 82 therebetween adapted to be interconnected with the second flange when the waveguides are uncoupled.

A female supplemental flange 86 is provided in a cylindrical configuration with internal screw threads 88 thereon. The female supplemental flange has a collar 90 located around the first waveguide and flexible coupling components 92 therebetween adapted to be interconnected with the first flange when the waveguides are uncoupled.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact constriction and operation shown and described, and accordingly, all suitable modifications and equivalents may be resorted to, falling within the scope of the invention.

What is claimed as being new and desired to be protected by Letters Patent of the United States is as follows:

1. A new and improved waveguide interconnection system adapted to readily couple and uncouple abutting waveguide sections comprising, in combination:

a first waveguide section having a rectangular cross-sectional configuration with an exterior end and an interior end;

a second waveguide section having a rectangular cross-sectional configuration with an exterior end and an interior end;

a male first flange in a cylindrical configuration, the first flange having an inboard surface in a planar configuration positionable over the first waveguide section adjacent to the interior end thereof, the first flange having an outboard surface, the first flange having a peripheral exterior surface with male threads formed thereon, the first flange having a generally rectangular opening centrally therethrough essentially coextensive as an extension of the cross-section of the waveguide;

a female second flange in a cylindrical configuration, the second flange positionable over the second waveguide section adjacent to the inboard end thereof, the second flange having an outboard surface and inboard surface in a generally planar configuration with a peripheral surface therebetween, the second flange having a generally rectangular opening centrally therethrough essentially coextensive as an extension of the cross-section of the second waveguide;

a coupler in a cylindrical configuration having a circular aperture adapted to contact an exterior surface of the second flange and having a recess with interior female threads extendable beyond an interior surface of the second flange into mating contact with the male threads of the first flange, the coupler having a knurled external periphery;

a pair of diametrically opposed locator pins extending outwardly from the first flange at diametrically opposed locations offset from both axes of the rectangular opening therein;

a pair of coacting opposed locator apertures in the second flange adapted to receive the pins of the first flange;

an annular recess formed in the first flange with an elastomeric O-ring situated therein for scaling the first and second flanges when coupled;

a supplemental male flange in a generally cylindrical configuration with external peripheral screw threads thereon with a collar located around the second waveguide and flexible coupling components therebetween adapted to be interconnected with the second flange when the waveguides are uncoupled; and a female supplemental flange in a cylindrical configuration with internal screw threads thereon with a collar located around the first waveguide and flexible coupling components therebetween adapted to be interconnected with the first flange when the waveguides are uncoupled.

2. A waveguide interconnection system comprising:

a first waveguide section having an exterior end and an interior end;

a second waveguide section having an exterior end and an interior end;

a first flange in a cylindrical configuration, the first flange having an inboard surface in a planar configuration positionable adjacent to the first waveguide section adjacent to the interior end thereof, the first flange having an outboard surface, the first flange having a peripheral exterior surface with male threads formed thereon, the first flange having an opening therethrough essentially coextensive as an extension of the cross-section of the waveguide;

a second flange in a cylindrical configuration, the second flange positionable adjacent to the second waveguide section adjacent to the inboard end thereof, the second flange having an outboard surface and inboard surface in a generally planar configuration with a peripheral surface therebetween, the second flange having an opening centrally therethrough essentially coextensive as an extension of the cross-section of the second waveguide;

a coupler in a cylindrical configuration having an aperture adapted to contact an exterior surface of the second flange and having a recess with interior female threads extendable beyond an interior surface of the second flange into mating contact with the male threads of the first flange, the coupler having a knurled external periphery;

a plurality of diametrically opposed locator pins extending outwardly from the first flange;

a plurality of coacting opposed locator apertures in the second flange adapted to receive the pins of the first flange.

3. The system as set forth in claim 2 and further including:

a female supplemental flange in a cylindrical configuration with internal screw threads thereon with a collar located around the first waveguide and flexible coupling components therebetween adapted to be interconnected with the first flange when the waveguides are uncoupled.

4. The system as set forth in claim 2 and further including:

an annular recess formed in the first flange with an elastomeric O-ring situated therein for sealing the first and second flanges when coupled.

5. The system as set forth in claim 2 wherein the coupler has a cylindrical configuration having an enlarged mass for creating forces for threadedly coupling the male threads of the first flange without excessive gripping forces by the user.

* * * * *